US010808725B2

(12) United States Patent
Dozzini et al.

(10) Patent No.: US 10,808,725 B2
(45) Date of Patent: Oct. 20, 2020

(54) TURBOMACHINE AND METHOD OF OPERATING A TURBOMACHINE

(71) Applicant: Nuovo Pignone Tecnologie Srl, Florence (IT)

(72) Inventors: Matteo Dozzini, Perugia (IT); Massimiliano Ortiz Neri, Pisa (IT); Massimiliano Borghetti, La Spezia (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 70 days.

(21) Appl. No.: 15/889,270

(22) Filed: Feb. 6, 2018

(65) Prior Publication Data

US 2018/0223869 A1 Aug. 9, 2018

(30) Foreign Application Priority Data

Feb. 6, 2017 (IT) ..... 102017000012500

(51) Int. Cl.
*F04D 29/58* (2006.01)
*F04D 29/058* (2006.01)
(Continued)

(52) U.S. Cl.
CPC ..... *F04D 29/582* (2013.01); *F01D 15/00* (2013.01); *F01D 25/166* (2013.01); *F01D 25/22* (2013.01);
(Continued)

(58) Field of Classification Search
CPC .... F04D 29/582; F04D 29/584; F04D 29/122; F04D 29/083; F04D 29/058; F04D 25/06;
(Continued)

(56) References Cited

U.S. PATENT DOCUMENTS 5,312,225 A * 5/1994 Lorenzen ..... F04D 29/058 415/105
6,043,580 A * 3/2000 Vogel ..... F04D 25/0606 310/179
(Continued)

FOREIGN PATENT DOCUMENTS

DE 25 15 315 A1 10/1976
EP 2 022 950 A1 2/2009
(Continued)

OTHER PUBLICATIONS

Detlef (EP 2022950 A1) Machine Translation (Year: 2007).*
(Continued)

*Primary Examiner* — Moshe Wilensky
*Assistant Examiner* — Brian Christopher Delrue
(74) *Attorney, Agent, or Firm* — Baker Hughes Patent Organization

(57) ABSTRACT

According to one aspect of the present disclosure, a turbomachine (100) is provided. The turbomachine includes: a rotor extending in an axial direction and comprising a driven side configured to be connected to a driving unit and a second side opposite the driven side; a housing extending around at least a portion of the rotor, wherein a main flow path for a process fluid extends between the rotor and the housing; a sealing arrangement, particularly a dry gas seal, configured for sealing a gap between the rotor and the housing at the driven side of the rotor; and a first magnetic bearing supporting the second side of the rotor. A fluid passage for a portion of the process fluid extends from the main flow path through a bearing gap of the first magnetic bearing. According to a further aspect, a method of operating a turbomachine is described.

19 Claims, 6 Drawing Sheets

(51) Int. Cl.

| | |
|---|---|
| ***F04D 19/04*** | (2006.01) |
| ***F04D 29/048*** | (2006.01) |
| ***F01D 15/00*** | (2006.01) |
| ***F01D 25/16*** | (2006.01) |
| ***F04D 29/12*** | (2006.01) |
| ***F01D 25/22*** | (2006.01) |
| ***F04D 29/08*** | (2006.01) |
| *F04D 17/12* | (2006.01) |
| *F04D 19/02* | (2006.01) |
| *F04D 25/04* | (2006.01) |
| *F04D 25/06* | (2006.01) |

(52) U.S. Cl.
CPC ..... *F04D 19/048* (2013.01); *F04D 29/048* (2013.01); *F04D 29/058* (2013.01); *F04D 29/083* (2013.01); *F04D 29/122* (2013.01); *F04D 29/584* (2013.01); *F04D 17/12* (2013.01); *F04D 19/02* (2013.01); *F04D 25/04* (2013.01); *F04D 25/06* (2013.01); *F05D 2240/51* (2013.01)

(58) Field of Classification Search
CPC ..... F04D 25/04; F04D 19/02; F04D 17/12; F01D 25/22; F01D 25/166; F01D 15/00; F05D 2240/51
See application file for complete search history.

(56) References Cited

U.S. PATENT DOCUMENTS

2007/0110596 A1* 5/2007 Weeber ..... F04D 29/5806 417/370
2007/0212238 A1* 9/2007 Jacobsen ..... F04D 1/063 417/423.1
2011/0008186 A1* 1/2011 Palomba ..... F04D 19/02 417/247
2012/0107143 A1* 5/2012 Gilarranz ..... F04D 25/0606 417/53
2013/0091869 A1* 4/2013 Bardon ..... F01D 15/005 62/6
2013/0136629 A1* 5/2013 Maier ..... F04D 17/122 417/366
2013/0294939 A1* 11/2013 Gilarranz ..... F04D 17/12 417/53
2014/0020393 A1* 1/2014 Nakamata ..... F23R 3/002 60/754
2015/0064026 A1* 3/2015 Maier ..... F04D 17/122 417/53

FOREIGN PATENT DOCUMENTS

EP 2022950 A1 * 2/2009 ..... F01D 25/16
GB 2 417 523 A 3/2006
WO 2011/088371 A2 7/2011
WO 2012/145486 A2 10/2012

OTHER PUBLICATIONS

Dry gas seal—Wikipedia, the free encyclopedia (Year: 2012).*
Italian Search Report and Written Opinion issued in connection with corresponding IT Application No. 102017000012500 dated Oct. 26, 2017.
Extended European Search Report and Opinion issued in connection with corresponding EP Application No. 18154961.9 dated Jun. 21, 2018.

* cited by examiner

TURBOMACHINE AND METHOD OF OPERATING A TURBOMACHINE

TECHNICAL FIELD

The present disclosure relates to turbomachines such as turbo-compressors and pumps which include a rotatable rotor configured for processing a process fluid. More specifically, the present disclosure relates to a turbomachine with a rotor configured to be connected to a driving unit such as a motor for rotating the rotor. The present disclosure further relates to a method of operating a turbomachine. More specifically, methods of operating a turbomachine while reliably cooling one or more magnetic bearings of the turbomachine are described.

BACKGROUND

A turbomachine is a machine that transfers energy between a rotatable rotor and a process fluid such as a process gas. For example, a turbomachine may be configured as a turbo-compressor for transferring energy from the rotating rotor to the process fluid for pressurizing the process fluid. A turbomachine may alternatively be configured as a pump that transports the process fluid between an inlet and an outlet, wherein a flow path of the process fluid extends past an impeller of the pump.

In a turbo-compressor, the pressure of a compressible process fluid is increased through the use of mechanical energy. Compressors can be used in different applications. For example, a compressor can be used in a gas turbine for pressurizing a gas. A gas turbine can be used in various industrial processes, including power generation, natural gas liquefaction and other processes.

A rotatable rotor of the turbomachine with one or more impellers is typically arranged in a housing which constitutes the stationary part of the turbomachine. The impellers may be mounted on the rotor, and a pressure rise can be achieved by adding kinetic energy to a continuous flow of process fluid directed past the rotating impellers. The kinetic energy can then be converted to an increase in static pressure by slowing the gas flow through a stationary diffuser which is part of the housing.

Typically, one, two or more bearings may support the rotor. For example, at least one bearing may support the rotor on a first side of the one or more impellers, and at least one further bearing may support the rotor on a second side of the one or more impellers opposite the first side. One or more radial bearings may be provided for taking up radial loads of the rotor and/or one or more thrust bearings may be provided for taking up axial loads of the rotor. The bearings are typically cooled, e.g. with a cooling fluid.

One of the relevant issues related to a turbomachine is the reliable sealing of the flow path of the process fluid in the turbomachine with respect to an environment of the turbomachine. Providing an excellent sealing between a stationary housing part and the rotating rotor may be complex due to a potentially high pressure difference between the flow path inside the turbomachine and the environment surrounding the turbomachine. So-called dry gas seals may be used for sealing a clearance between the rotating rotor and the stationary housing in order to prevent a contamination of the process fluid with a lubricant of the bearings and in order to reduce a leakage of the process fluid into the bearings and/or into the environment.

It would be beneficial to reduce the complexity of a turbomachine with a rotor that is supported by one or more bearings, while at the same time reliably sealing a flow path of the turbomachine from an environment of the turbomachine. Further, it would be beneficial to provide a method of operating a turbomachine while reliably cooling one or more bearings of the turbomachine.

SUMMARY

In light of the above, a turbomachine, a turbomachine arrangement as well as a method of operating a turbomachine are provided.

According to one aspect of the present disclosure, a turbomachine is provided. The turbomachine includes: a rotor extending in an axial direction and comprising a driven side configured to be connected to a driving unit and a second side opposite the driven side; a housing extending around at least a portion of the rotor, wherein a main flow path for a process fluid extends between the rotor and the housing; a sealing arrangement configured for sealing a gap between the rotor and the housing at the driven side of the rotor; and a first magnetic bearing supporting the second side of the rotor, wherein a fluid passage for a portion of the process fluid extends from the main flow path through a bearing gap of the first magnetic bearing.

In some embodiments, the sealing arrangement, particularly a dry gas seal, may be arranged at the driven side of the rotor, but no further dry gas seal may be arranged at the second side of the rotor.

In some embodiments, the turbomachine may be a semi-sealed turbomachine, wherein the second side of the rotor ends within the housing and/or is sealed by the housing, wherein only the driven side of the rotor may protrude out of the housing. In other embodiments both the driven side and the second side of the rotor may protrude out of the housing. In the latter case, a seal, particularly a dry gas seal, may be provided on both sides of the turbomachine.

According to a further aspect of the present disclosure, a turbomachine arrangement is provided. The turbomachine arrangement includes a turbomachine according to any of the embodiments described herein, and a driving unit connected to the driven side of the rotor of the turbomachine for rotating the rotor.

According to a further aspect, a method of operating a turbomachine is provided. The method includes: driving a rotor of the turbomachine via a driving unit connected to a driven side of the rotor; directing a process fluid along a main flow path extending between the rotor and a housing of the turbomachine, wherein, at the driven side of the rotor, a gap between the rotor and the housing is sealed, particularly with a dry gas seal; and cooling a first magnetic bearing which supports a second side of the rotor opposite to the driven side with a portion of the process fluid.

Further aspects, advantages, and features of the present disclosure are apparent from the dependent claims, the description, and the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following. Some embodiments are depicted in the drawings and are detailed in the description which follows.

DETAILED DESCRIPTION

Reference will now be made in detail to the various embodiments of the disclosure, one or more examples of which are illustrated in the figures. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to corresponding or to similar components. Generally, only the differences with respect to the individual embodiments are described. Unless specified otherwise, the description of a part or aspect in one embodiment applies to a corresponding part or aspect in another embodiment as well.

Figure 1:
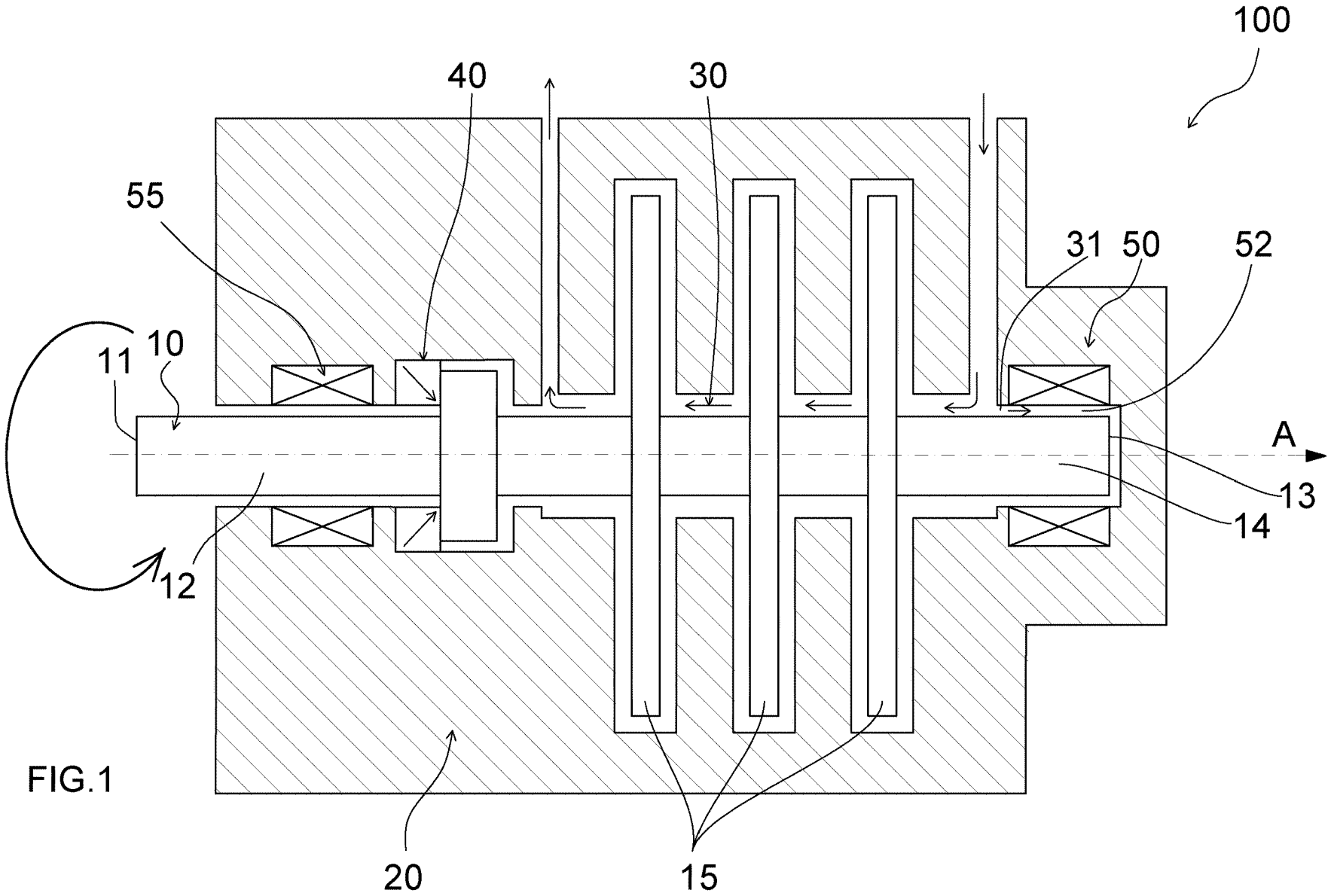
FIG. 1 is a schematic sectional view of a turbomachine according to embodiments described herein.

FIG. 1 shows a turbomachine 100 according to embodiments described herein in a schematic sectional view along an axial direction A of a rotor 10 of the turbomachine.

The turbomachine 100 may be a turbo-compressor configured for pressurizing a process fluid, particularly a process gas, as is schematically depicted in FIG. 1. In other embodiments, the turbomachine may be an expander for expanding a process fluid, particularly a process gas. In yet further embodiments, the turbomachine may be pump configured for pumping a process fluid, particularly a gas or a liquid, from an inlet to an outlet of the turbomachine. In yet further embodiments, the turbomachine may be a turbine configured for driving a shaft. However, the present disclosure is not limited to these examples, and yet further types of turbomachines may be provided.

The turbomachine 100 may be a part of a gas turbine, a power plant and/or a gas liquefaction system. Other applications are possible.

The turbomachine 100 may be a standalone turbomachine, particularly a standalone turbo-compressor. In other words, as compared to an integrated machine having a driving unit and a compressor unit integrated in a common sealed housing with a common shaft, the turbomachine according to some embodiments described herein may be connectable to a driving unit, e.g. a motor, which may be provided as a separate unit with a separate housing. In particular, no direct fluid connection between an interior of the driving unit and an interior of the turbomachine may be provided. In a standalone turbomachine, providing an excellent seal between the interior of the turbomachine and an environment of the turbomachine may be beneficial, particularly when a portion of the rotor protrudes out of a housing of the turbomachine into a surrounding environment or into an adjacent housing.

Among the various types of turbo-compressors are radial compressors or centrifugal compressors, axial compressors, and mixed flow compressors. In an axial compressor, the process fluid may stream past one or more impellers in an axial direction essentially parallel to the shaft. In a centrifugal compressor, the process fluid may stream axially toward an impeller, where the gas is deflected in a radial outward direction.

Turbo-compressors can be provided with a single impeller, i.e. in a single stage configuration, or with a plurality of impellers in series, in which case the compressor may be referred to as a multistage compressor. Each of the stages of a compressor typically includes an inlet for the process fluid, an impeller which is capable of providing kinetic energy to the process fluid and an outlet which converts the kinetic energy of the process fluid into pressure energy.

As is schematically depicted in FIG. 1, the turbomachine 100 includes a rotor 10 which extends along the axial direction A and is configured to rotate around an axis, and a housing 20 which surrounds at least a portion of the rotor 10. The rotor 10 may include one or more impellers 15 configured for moving the process fluid which streams past the one or more impellers 15.

As is further shown in FIG. 1, the rotor 10 includes a driven side 12 which is configured to be connected directly or indirectly to the driving unit (not shown in FIG. 1) and a second side 14 which is arranged in the axial direction opposite the driven side. In some embodiments, the second side 14 of the rotor may terminate within the housing. One or more impellers 15 of the rotor may be arranged between the driven side 12 and the second side 14 of the rotor.

The term "driven side of the rotor" as used herein may be understood as a portion of the rotor opposite the second side 14, particularly between the one or more impellers 15 of the rotor and a driven end 11 of the rotor which is connectable to a driving unit (not shown in FIG. 1). The driven side 12 of the rotor may not be completely sealed by the housing, so that the driven end 11 of the rotor can be connected to the driving unit which may be provided as further unit separate from the turbomachine 100. In particular, the driven end 11 of the driven side 12 may be accessible or may protrude from an interior of the housing 20 so that the driving unit can be connected thereto directly or indirectly, e.g. via a transmission means such as a gear. In some embodiments, at least one further machine, e.g. a further turbocompressor, may be arranged between the driving unit and the turbomachine 100.

The term "second side of the rotor" as used herein may be understood as a portion of the rotor opposite to the driven side of the rotor, e.g. a portion including a free axial end 13 of the rotor. In some embodiments, the second side 14 of the rotor terminates within the housing 20 of the turbomachine (see, e.g., FIG. 1 and FIG. 2). For example, the second side 14 of the rotor may extend between the free axial end 13 of the rotor and one or more impellers 15 of the rotor. The second side 14 of the rotor may be enclosed by the housing 20. In particular, the housing 20 may not only circumferentially surround the second side 14 of the rotor, but may also cover the front end of the second side 14 so that the housing may completely seal the second side 14 of the rotor from an environment of the turbomachine.

In other embodiments, the second side 14 of the rotor protrudes out of the housing 20 of the turbomachine. In particular, both the driven side 12 and the second side 14 may protrude out of the housing. For example, a further turbomachine which may also be driven by the driving unit may be arranged on the second side 14 of the rotor. In these cases, the second side 14 of the rotor is not sealed by the housing, but a further seal, e.g. a further dry gas seal, may be arranged on the second side 14 of the rotor, in order to seal the main flow path 30 from an environment of the turbomachine. The further dry gas seal may be arranged on an outboard side of the first magnetic bearing 50.

In the embodiments shown in FIG. 1, the free axial end 13 of the rotor is surrounded and sealed by the housing, but the driven end 11 of the rotor may be in fluid connection with the environment and/or may protrude out of the housing. For this reason, the turbomachine 100 according to some embodiments described herein may also be referred to as a "semi-sealed" turbomachine. For example, in FIG. 1, the driven side 12 of the rotor on the left side protrudes from the housing, but the second side 14 of the rotor on the right side is sealed by the housing, particularly by a front wall 22 and a side wall 23 of the housing. In other words, the housing 20 itself may act as a seal.

The driving unit may be a motor, e.g. an electric motor or a hydraulic motor, a turbine, e.g. a gas turbine or a steam turbine, or another driver which is configured for rotating the rotor 10 of the turbomachine 100. However, the present disclosure is not limited thereto. For example, the turbomachine 100 may be configured as a turbine, and the driving unit may be a rotary machine which is driven by the turbine.

In some embodiments, the driving unit is detachably connected to the driven side 12 of the rotor 10. For example, the driving unit is a motor which is arranged in a separate housing, wherein a driving shaft of the motor can be connected to the driven end 11 of the rotor 10 of the turbomachine for driving the turbomachine. In some embodiments, a transmission mechanism, e.g. a gear, a belt drive or another appropriate force transmission means may be connected between the driving unit and the turbomachine. Accordingly, at the driven side 12 of the rotor, the main flow path 30 is to be sealed from the environment surrounding the driven end 11 of the rotor, because the environment of the driven end may have a pressure which is different from the pressure within the main flow path 30.

The turbomachine 100 further includes the housing 20 which extends around at least a portion of the rotor 10. The main flow path 30 for the process fluid extends between the rotor 10 and the housing 20. The term "housing" as used herein may be understood as referring to a plurality of stationary parts of the turbomachine which are configured to house and surround the rotor 10, wherein the main flow path 30 of the process fluid is formed between the rotor and at least a part of the housing. For example, the housing 20 may not only include an outer casing of the turbomachine, but may further include the stator of the turbomachine, wherein the main flow path of the process gas may at least partially extend between the stator and the rotor. The term "rotor" as used herein may be understood as referring to a rotor arrangement comprising a shaft extending in the axial direction A as well as one or more impellers 15 mounted thereon or integrally formed therewith which are arranged within the housing.

A sealing arrangement 40 configured for sealing a gap between the rotor 10 and the housing 20 is provided at the driven side 12 of the rotor. The sealing arrangement 40 may be configured for sealing the main flow path 30 of the turbo-compressor from an environment of the turbo-compressor. For example, the sealing arrangement 40 may provide a sealing between the main flow path 30 and the driving unit which may be connected to the driven end 11. The sealing arrangement 40 may reduce or prevent a flow of the process fluid from the main flow path 30 through a clearance between the rotor and the housing at the driven side toward the outside of the turbomachine. The sealing arrangement 40 may reduce or prevent a contamination of the process fluid in the main flow path 30 from an environment surrounding the driven end of the rotor.

A reliable sealing of a clearance between the rotor and the housing at the driven side of the rotor may be difficult, particularly when a high pressure difference may exist between the main flow path 30 and an adjacent environment, e.g. an ambient environment, into which the driven end of the rotor may protrude.

In some embodiments, which may be combined with other embodiments described herein, the sealing arrangement 40 may include at least one dry gas seal. A dry gas seal is suitable for providing an excellent sealing at the driven side of the rotor.

Dry gas seals are typically applied for sealing purposes in centrifugal compressors. A dry gas seal may be configured as a non-contacting mechanical face seal including a rotating ring mounted to the rotor and a stationary ring mounted to the housing. During rotation of the turbomachine, a lifting geometry of the rotating ring and/or of the stationary ring may generate a lifting force. Accordingly, the rotating ring may lift from the stationary ring and form a sealing gap between the rotating ring and the stationary ring.

Figure 3:
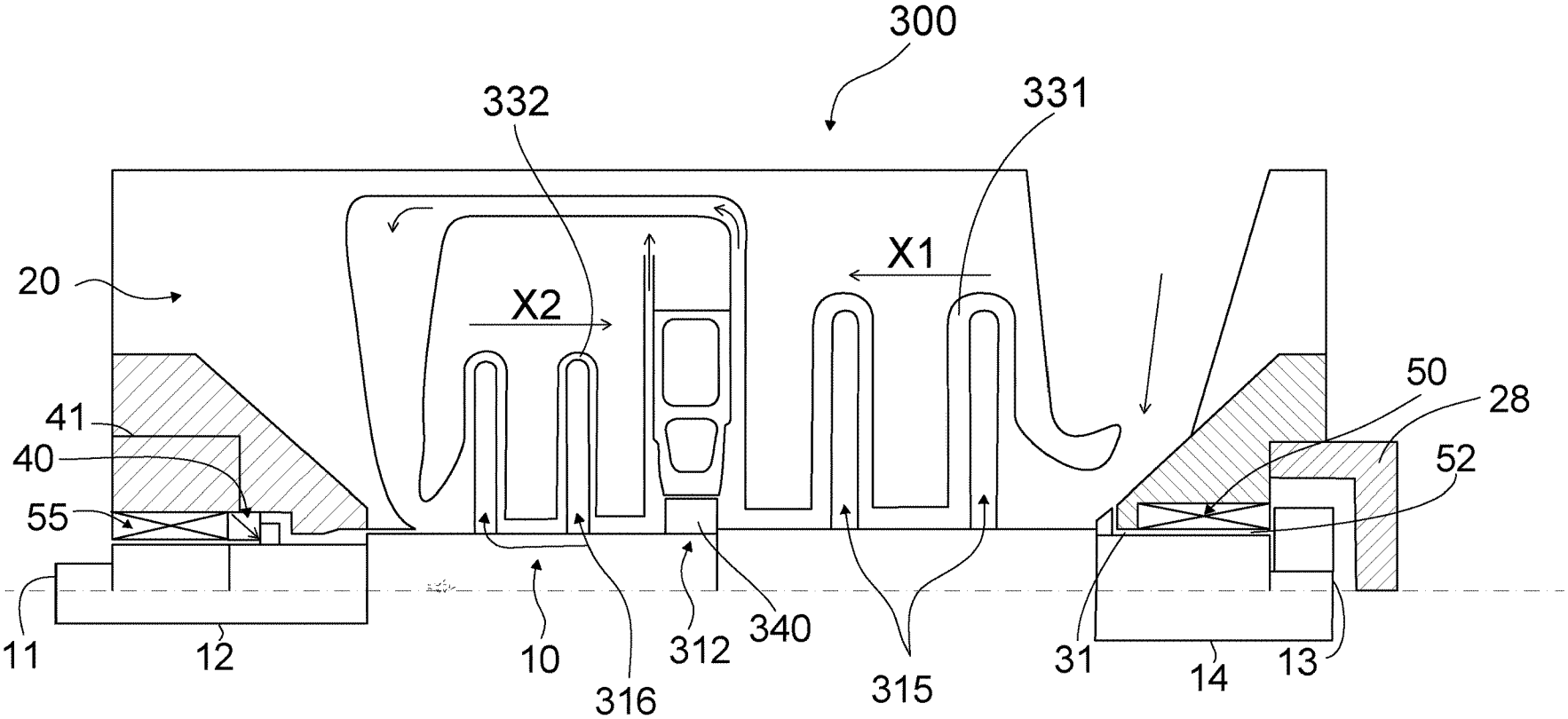
FIG. 3 is a schematic sectional view of a turbomachine according to embodiments described herein which is configured as a back-to-back turbo-compressor.

A sealing gas may be injected into the dry gas seal. The sealing gas provides the working fluid for the sealing gap and increases the sealing properties between the process fluid and the surrounding environment. In FIG. 3, a sealing gas channel 41 for injecting the sealing gas is schematically illustrated. In some embodiments, a labyrinth seal may be provided inboard of the dry gas seal, which may provide a separation of the process fluid from the sealing gas. A further seal such as a further labyrinth seal may be arranged outboard of the dry gas seal for separating the sealing gas from the environment. In some embodiments, the sealing gas may be an inert gas.

The dry gas seal may be provided as a single seal, as a tandem seal, or as a multiple seal. For example, the dry gas seal may include a primary seal and a secondary seal.

The rotor 10 may be supported by bearings at both sides thereof. In particular, a first bearing may be provided for supporting the second side 14 of the rotor and a second bearing may be provided for supporting the driven side 12 of the rotor. Additional bearings may be provided, e.g. axial and/or radial bearings.

The first bearing which supports the second side 14 of the rotor may be a first magnetic bearing 50. The first magnetic bearing 50 may be arranged at a close distance from the free axial end 13 of the rotor 10. For example, a distance between the first magnetic bearing 50 and the free axial end 13 may be 20 cm or less, particularly 10 cm or less, more particularly 2 cm or less.

The first magnetic bearing 50 may be an active magnetic bearing (AMB). Magnetic bearings may be used instead of conventional oil-lubricated bearings as an axial and/or radial rotatable support for the rotor. Magnetic bearings operate based on electromagnetic principles to control axial and radial displacements of the rotor. The first magnetic bearing may include at least one electromagnet driven by a power amplifier which regulates the voltage and therefore the current in the coils of the electromagnet as a function of a feedback signal which indicates displacement of the rotor inside the housing. Magnetic bearings may not require oil as a lubricant, so that the overall maintenance of the compressor can be reduced.

According to embodiments described herein, a fluid passage 31 for a portion of the process fluid extends from the main flow path 30 through a bearing gap 52 of the first magnetic bearing 50. In other words, the main flow path 30 may be fluidly open toward the bearing gap 52 of the first magnetic bearing so that a portion of the process fluid may enter the bearing gap 52 from the main flow path 30. In particular, a portion of the process fluid may flow from the main flow path 30 through a clearance 32 between the rotor and the housing into the bearing gap 52 of the first magnetic bearing.

The portion of the process fluid which enters the bearing gap 52 may be used for cooling the first magnetic bearing 50. In particular, the process fluid may be used as a cooling fluid for the first magnetic bearing 50. No further cooling fluid for cooling the first magnetic bearing may be necessary in at least some embodiments. Accordingly, the turbomachine according to embodiments described herein is simplified as compared to previously used turbomachines which used an additional cooling circuit and/or additional cooling channels for cooling a bearing on the second side of the rotor.

In some embodiments, which may be combined with other embodiments described herein, the fluid passage 31 extends from the main flow path 30 along a clearance 32 between the rotor 10 and the housing 20 through the bearing gap 52, and particularly beyond the free axial end 13 of the rotor. For example, the fluid passage 31 may extend around the second side 14 of the rotor, may circumferentially surround the rotor 10 and may enclose the free axial end 13 of the rotor. A front wall 22 of the housing 20 may separate and seal the fluid passage 31 from an environment of the turbomachine.

In some embodiments, no dry gas seal is provided at the second side 14 of the rotor so that the process fluid can enter the clearance 32 between the rotor and the housing which surrounds the second side 14 of the rotor, without being blocked by a dry gas seal. In particular, whereas the sealing arrangement 40 at the driven side 12 of the rotor may be configured as a dry gas seal, no further dry gas seal may be provided at the second side 14 of the rotor. The second side 14 of the rotor may be sealed from the environment by the walls of the housing which may surround the second side 14 of the rotor. In particular, in some embodiments, no further dry gas seal for sealing a clearance between the rotor and the housing may be provided in the axial direction A between one or more impellers 15 of the rotor and the first magnetic bearing 50 and/or between the first magnetic bearing 50 and the free axial end 13 of the rotor 10.

No further dry gas seal may be provided at the second side 14 of the rotor in some embodiments. However, the process fluid flow path may be constricted or tapered at a transition between the main flow path 30 and the fluid passage 31, in order to prevent that a large portion of the process fluid enters the fluid passage 31. For example, a flow barrier may be provided between the main flow path 30 and the fluid passage 31. In particular, a transition between the main flow path 30 and the fluid passage 31 may be configured such that only a small portion of the process fluid, e.g. less than 10% or less than 5% enters the fluid passage 31.

When no dry gas seal is provided at the second side 14 of the rotor, the rotor length can be reduced as compared to other turbomachines which include a dry gas seal also at the second side of the rotor. Further, the complexity of the turbomachine can be reduced and the maintenance can be simplified, as no dry gas seal on the second side of the rotor needs to be maintained. Additionally, due to the reduced shaft length, the rotor-dynamic behavior and the machine efficiency can be improved. In particular, an extended second side of the rotor may lead to rotor instabilities and may increase the power that is needed for rotating the rotor due to an increased weight and/or an increased friction of the rotor. On the other hand, a second side of the rotor having a reduced length may improve the rotational behavior of the rotor and may increase the machine reliability.

Further, costs can be reduced, as the number of dry gas seals is reduced and the energy for driving the turbomachine at a predetermined rotational speed can be decreased. What is more, the amount of inert gas, sealing gas and/or cooling gas may be reduced, because no sealing gas for a further dry gas sealing on the second side is needed, and/or no additional cooling gas for cooling the first magnetic bearing on the second side of the rotor may be required.

When the second side of the rotor is completely sealed from the environment, a leakage of the process fluid from the fluid passage 31 into the environment can be reduced or completely avoided. For example, a side wall 23 and/or a front wall 22 of the housing 20 which surround the second side 14 of the rotor may completely seal the fluid passage 31 from the environment.

According to some embodiments, the cooling of the first magnetic bearing on the second side 14 of the rotor is simplified, because the first magnetic bearing can be cooled with the process fluid which may enter the bearing gap through a clearance between the rotor and the housing, and no further cooling source and/or no further cooling channel for introducing a cooling fluid to the first magnetic bearing 50 may be needed.

As is depicted in FIG. 1, at least one second bearing, particularly a second magnetic bearing 55 may be provided at the driven side 12 for supporting the driven side 12 of the rotor 10. In particular, a first active magnetic bearing may be provided for supporting the second side 14 of the rotor, and a second active magnetic bearing may be provided for supporting the driven side 12 of the rotor. The one or more impellers of the rotor may be provided between the first magnetic bearing 50 and the second magnetic bearing 55. In some embodiments, each magnetic bearing may include at least one axial bearing and at least one radial bearing.

As is exemplarily depicted in FIG. 1, in some embodiments, the second magnetic bearing 55 may be arranged outboard of the sealing arrangement 40, i.e. in the axial direction between the sealing arrangement 40 and the driven end 11 of the rotor. In other embodiments, the second magnetic bearing 55 may be arranged inboard of the sealing arrangement 40, i.e. in the axial direction between the sealing arrangement 40 and the one or more impellers, as is shown in further detail below.

Figure 2:
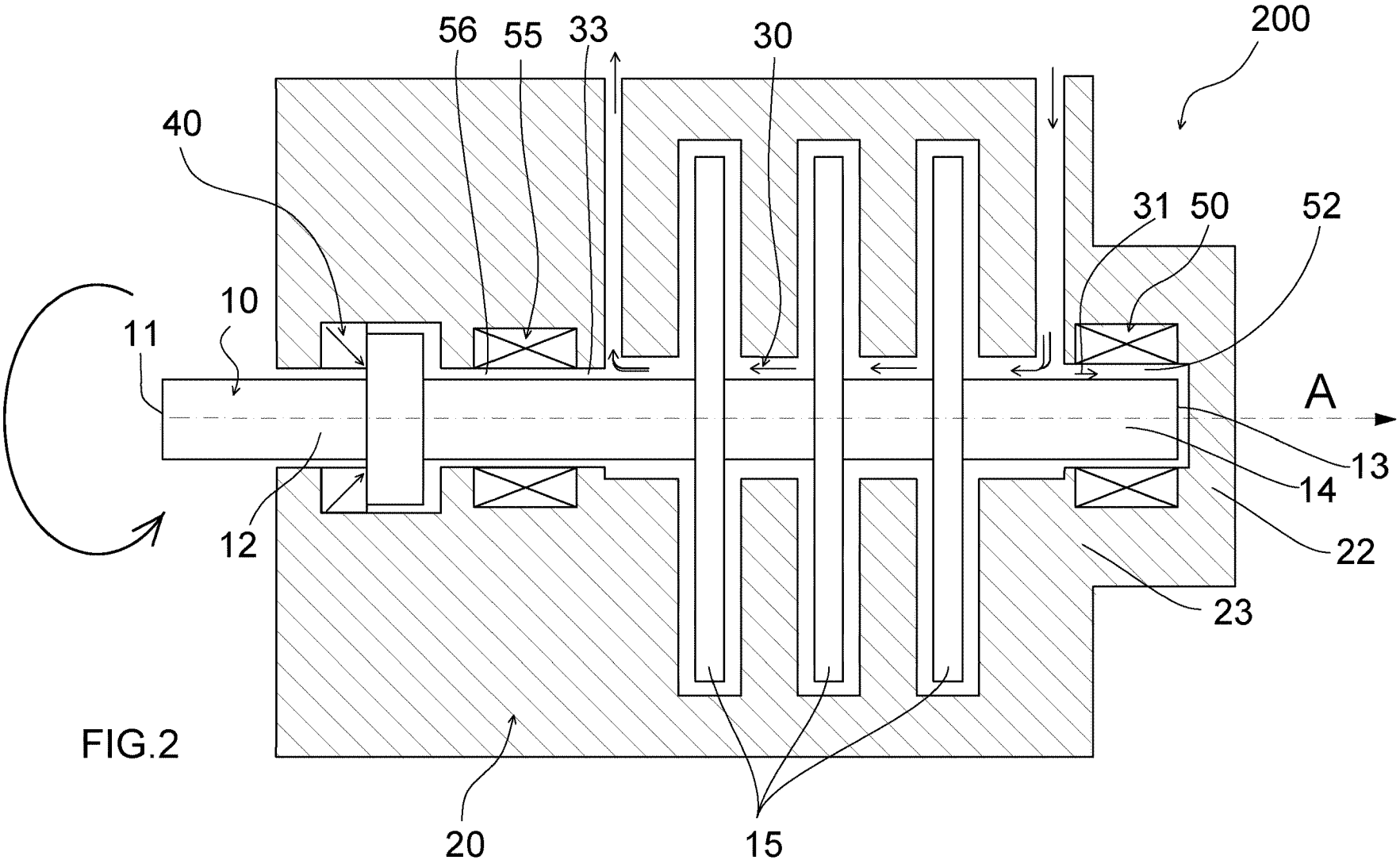
FIG. 2 is a schematic sectional view of a turbomachine according to embodiments described herein.

FIG. 2 shows a turbomachine 200 according to embodiments described herein in a schematic sectional view along an axial direction A of the rotor 10 of the turbomachine 200. The turbomachine 200 of FIG. 2 is similar to the turbomachine 100 of FIG. 1 so that reference can be made to the above explanations which are not repeated here. However, the positioning of the second magnetic bearing 55 and of the sealing arrangement 40 are different from the embodiment of FIG. 1.

The turbomachine 200 may be at least one of a compressor configured for pressurizing the process fluid, an expander configured for expanding the process fluid, and a pump configured for pumping the process fluid. The rotor 10 may include one or more impellers 15 which are arranged in the axial direction A between a first magnetic bearing 50 which is provided to support the second side 14 and a second magnetic bearing 55 which is provided to support the driven side 12. Both the first magnetic bearing 50 and the second magnetic bearing 55 may be configured as active magnetic bearings in some embodiments.

The sealing arrangement 40 which is arranged at the driven side 12 of the rotor for sealing a gap between the rotor 10 and the housing 20 may be configured as a dry gas seal. No (further) dry gas seal may be provided at the second side 14 of the rotor in some embodiments.

According to one aspect of the present disclosure, the main flow path 30 of the turbomachine 200 may be (fluidly) open toward the bearing gap 52 of the first magnetic bearing 50 at the second side 14 of the rotor, and the main flow path 30 may further be (fluidly) open toward a second bearing gap 56 of the second magnetic bearing 55 at the driven side 12 of the rotor. For example, the main flow path 30 may be in fluid connection with the bearing gaps of the first and second magnetic bearings. In particular, a portion of the process fluid may be allowed to stream into the bearing gap 52 of the first magnetic bearing 50 through the fluid passage 31, and a further portion of the process fluid may be allowed to stream into the second bearing gap 56 of the second magnetic bearing 55 through a second fluid passage 33 which is provided at the driven side of the rotor.

In some embodiments, the second fluid passage 33 may extend from the main flow path 30 through the second bearing gap 56 for cooling the second magnetic bearing 55. The second fluid passage 33 may extend from the main flow path 30 through a clearance between the rotor and the housing toward the second bearing gap 56 and toward the sealing arrangement 40 which may be arranged on the outboard side of the second magnetic bearing 55. The sealing arrangement 40 may block a flow of process fluid in the direction of the driven end of the rotor and may thereby terminate the second fluid passage 33.

In some embodiments, which may be combined with other embodiments described herein, the second magnetic bearing 55 may be arranged in the axial direction A between the sealing arrangement 40 and the main flow path 30, and the second fluid passage 33 may extend between the main flow path 30 and the sealing arrangement 40. In particular, the second magnetic bearing may be arranged between the sealing arrangement 40 and the one or more impellers 15.

As comparted to the embodiment of FIG. 1, the positions of the sealing arrangement 40 and of the second magnetic bearing 55 may be exchanged so that a direct cooling of the second magnetic bearing 55 with the process fluid is possible.

In the turbomachine 200 of FIG. 2, the sealing arrangement 40 may be arranged at the driven side of the rotor, and no further bearing may be arranged on the outboard side of the sealing arrangement 40. The accessibility of the sealing arrangement 40 may be improved and the maintenance of the sealing arrangement 40 may be facilitated. In particular, the sealing arrangement may be arranged adjacent to a sidewall 24 of the housing 20.

FIG. 3 shows a turbomachine 300 according to embodiments described herein in a schematic sectional view along an axial direction A of the rotor 10 of the turbomachine 300.

The turbomachine 300 may be a compressor configured for pressurizing the process fluid. The rotor 10 may include a plurality of impellers which are arranged in the axial direction A on the rotor 10 between a first magnetic bearing 50 which is provided to support the second side 14 of the rotor and a second magnetic bearing 55 which is provided to support the driven side 12 of the rotor. Both the first magnetic bearing 50 and the second magnetic bearing 55 may be active magnetic bearings.

A sealing arrangement 40, particularly a dry gas seal, may be arranged at the driven side 12 of the rotor. In some embodiments, no dry gas seal may be arranged at the second side 14 of the rotor, and the second side 14 of the rotor may be sealed and surrounded by walls 28 of the housing 20 of the turbomachine. In other embodiments, at least one further seal, particularly a further dry gas seal may be arranged at the second side 14 of the rotor on the outboard side of the magnetic bearing, and the second side 14 may protrude out of the housing 20.

The turbomachine 300 of FIG. 3 may be configured as a back-to-back turbo-compressor. The rotor 10 may include a first plurality of impellers 315 and a second plurality of impellers 316 arranged between the driven side 12 and the second side 14 of the rotor, and the main flow path may include a first flow path section 331 extending in a first main flow direction X1 past the first plurality of impellers 315 and a second flow path section 332 extending in a second main flow direction X2 past the second plurality of impellers 316.

In some embodiments, the first main flow direction X1 and the second main flow direction X2 may be opposite directions. For example, the first flow path section 331 may generally extend from the second side 14 of the rotor 10 toward a middle portion 312 of the rotor, and the second flow path section 332 may generally extend from the driven side 12 of the rotor toward the middle portion 312 of the rotor.

In some embodiments, a barrier 340 may be arranged at the middle portion 312 of the rotor, between the first plurality of impellers 315 and the second plurality of impellers 316, in order to reduce a flow of the process fluid through a gap between the rotor and the housing at the middle portion 312 from the first flow path section 331 to the second flow path section 332 and/or vice versa. The barrier 340 may include a seal such as a labyrinth seal. The barrier may be configured for a first pressure on a first axial side of the barrier and for a second pressure on a second axial side of the barrier.

In some embodiments, which may be combined with other embodiments described herein, the turbomachine 300 may include at least one balance drum configured to compensate an axial thrust of the rotor 10 by providing a pressure difference between a high-pressure side and a low-pressure side of the balance drum. For example, the barrier 340 between the first plurality of impellers and the second plurality of impellers may include a balance drum, particularly including a seal such as a labyrinth seal in the gap between the rotor and the housing. Alternatively or additionally, a balance drum may be arranged at the driven side of the rotor and/or at the second side of the rotor.

Turbomachines, in particular turbo-compressors, may be subjected to an axial thrust on the rotor caused by the differential pressure across the various compressor stages and the change of momentum of the process fluid. This axial thrust can be at least partially compensated by the balance drum and/or by an axial bearing. Since an axial bearing can typically not be loaded by the entire thrust of the rotor, the balance drum may be designed to compensate for a portion of the thrust, leaving an (optional) axial bearing to handle any remaining thrust. In some embodiments, no axial bearing may be necessary. The balance drum may be implemented as a rotating disc, step or protrusion which is fitted onto the rotor or which is integrally formed with the rotor. Each side of the balance drum may be subjected to a different pressure during operation. In some embodiments, the diameter of the balance drum may be chosen to have an appropriate axial load to prevent the residual load from overloading an axial bearing. Providing a balance drum may be beneficial in combination with one or more magnetic bearings which may not be able to take sufficient axial loads of the rotor. In some embodiments, which may be combined with other embodiments described herein, the turbomachine may include a balance drum arranged on a high-pressure side of at least one impeller.

In some embodiments, the balance drum may be provided as a step, a disc, or a balance piston on the rotor. The shape of the balance drum is not particularly restricted, as long as the balance drum is capable of providing an at least partial compensation of the axial thrust of the rotor. A pressure difference may be maintained between a high-pressure side of the balance drum and a low-pressure side of the balance drum. The balance drum may include a balance drum seal configured to maintain the pressure difference between the high-pressure side and the low-pressure side of the balance drum. In some embodiments, the balance drum seal may be a labyrinth seal. The balance drum seal may be a rotating component which is fixed to the rotor, or the balance drum seal may alternatively be a stationary component which is fixed to a stationary part of the housing. In some embodiments, a first part of the balance drum seal is fixed to the rotor, and a second part of the balance drum seal is fixed to the housing.

The process fluid may subsequently flow through the first flow path section 331 and the second flow path section 332, and the pressure of the process fluid may increase stepwise while streaming past the first plurality of impellers 315 and the second plurality of impellers 316. In some embodiments, the first flow path section 331 and the second flow path section 332 may be subsequently arranged inside the housing 20 of the turbomachine 300. In some embodiments, at least a section of a flow path between the first flow path section 331 and the second flow path section 332 may extend outside the housing. In yet further embodiments, the first flow path section 331 and the second flow path section 332 may be separate flow paths, and/or different process fluids may stream through the first and second flow path sections.

In the embodiment shown in FIG. 3, the first flow path section 331 is a low pressure flow path section configured for pressurizing the process fluid from an entrance pressure to an intermediate pressure, and the second flow path section 332 is a high pressure flow path section configured for pressurizing the process fluid from the intermediate pressure to a discharge pressure. Different arrangements are possible. For example, the first and/or the second main flow directions may be inverted in some embodiments.

As is schematically depicted in FIG. 3, the first flow path section 331 is fluidly open toward the bearing gap 52 of the first magnetic bearing 50, and/or no dry gas seal is provided at the second side 14 of the rotor. The length of the rotor between the free axial end 13 and the first plurality of impellers 315 can be reduced and the rotor stability can be improved. A fluid passage 31 may extend from the first flow path section 331 through a clearance between the rotor and the housing toward the bearing gap 52 for cooling the first magnetic bearing.

In the embodiment of FIG. 3, the second magnetic bearing 55 is arranged outboard from the sealing arrangement 40. In other embodiments, the positions of the second magnetic bearing 55 and of the sealing arrangement 40 may be exchanged. A second fluid passage may extend from the second flow path section 332 through the second bearing gap of the second magnetic bearing 55, e.g. through a second clearance between the rotor and the housing, for cooling the second magnetic bearing. In this respect, reference is made to the embodiment shown in FIG. 2.

Figure 4A:
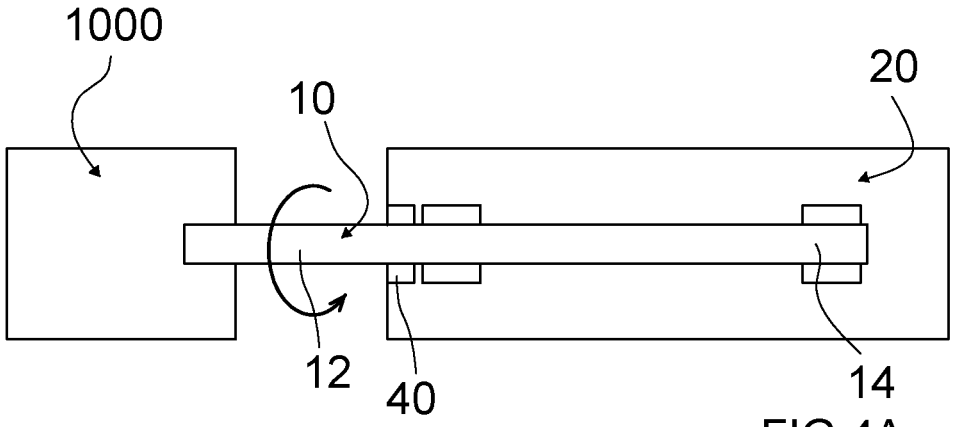
FIG. 4A is a schematic view of a turbomachine arrangement according to embodiments described herein.

According to a further aspect, a turbomachine arrangement is provided. FIG. 4A shows a schematic view of a turbomachine arrangement according to some embodiments. The turbomachine arrangement includes a turbomachine 100 according to any of the embodiments described herein and a driving unit 1000 which is directly or indirectly connected to the driven side 12 of the rotor 10 of the turbomachine for rotating the rotor 10.

The driving unit 1000 may be a motor, e.g. an electric or a hydraulic motor, a turbine, e.g. a gas turbine, or another driving device.

The turbomachine 100 may be a "semi-sealed" turbomachine with a housing 20 which surrounds and seals the second side 14 of the rotor 10 from an ambient environment. The driven side 12 of the rotor may protrude from an interior of the housing 20 of the turbomachine into an environment which has a pressure which is different from the pressure of the interior of the turbomachine.

In some embodiments, the turbomachine 100 may include a sealing arrangement 40, particularly dry gas seal, at the driven side 12 of the rotor for sealing the main flow path from an environment of the turbomachine. No further dry gas seal may be provided at the second side 14 of the rotor.

Figure 4B:
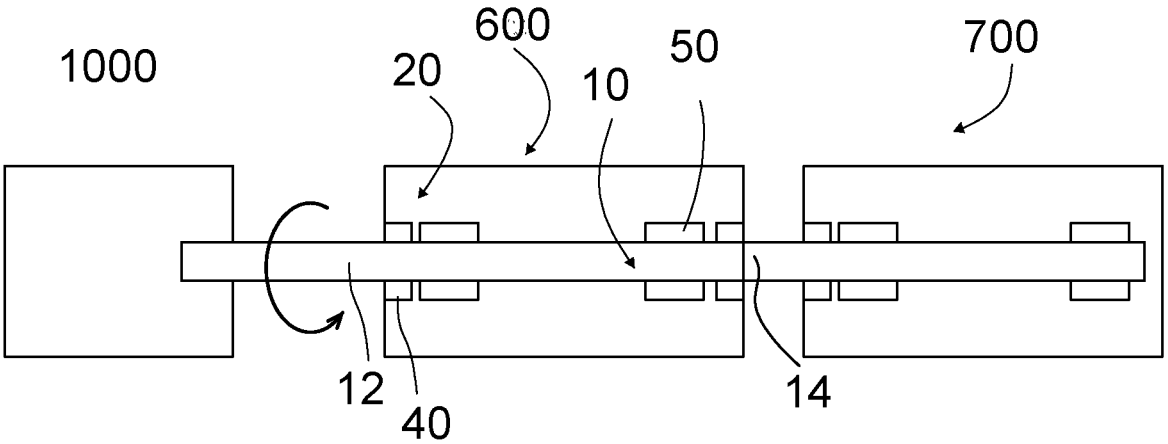
FIG. 4B is a schematic view of a turbomachine arrangement according to embodiments described herein.

FIG. 4B shows a turbomachine arrangement according to some embodiments described herein. The turbomachine arrangement includes a turbomachine 600 according to some embodiments described herein, which is not configured as a "semi-sealed" turbomachine. The rotor 10 may protrude from both sides of the housing 20 of the turbomachine 600. A further turbomachine 700 which may or may not be configured as a "semi-sealed" turbomachine may be arranged on the second side 14 of the rotor of the turbomachine 600. The further turbomachine 700 may be configured according to any of the embodiments described herein.

In some embodiments, the turbomachine 600 includes a seal, particularly a dry gas seal, on both sides of the rotor, i.e. on the driven side 12 and on the second side 14 opposite the driven side. The side of the rotor 10 which is directed toward the driving unit 1000 is the driven side 12 of the rotor of the turbomachine 600, and the side of the rotor 10 which is directed toward the further turbomachine 700 is the second side 14 of the turbomachine 600.

The turbomachine 600 may have two or more dry gas seals for sealing an interior of the turbomachine 600 from an environment on both axial sides of the rotor.

In some embodiments, the turbomachine 600 may have two magnetic bearings, particularly at least one magnetic bearing on each side of the rotor 10. At least one of the magnetic bearings, particularly the first magnetic bearing 50 on the second side 14, may be arranged inboard of the seals. For example, as is schematically shown in FIG. 4B, both magnetic bearings may be arranged between on an inboard side of the respective seal on both sides of the rotor. One or both magnetic bearings may be cooled directly by the process fluid.

In some embodiments, at least one magnetic bearing may be arranged outboard of the respective seal of the turbomachine 600.

In some embodiments, a plurality of turbomachines may be driven by the driving unit 1000 and may extend at least partially around the rotor 10, e.g. in a linear arrangement or train, wherein at least one of the turbomachines may be a semi-sealed turbomachine. Some or all of the turbomachines may be turbomachines according to embodiments described herein.

According to a further aspect described herein, a method of operating a turbomachine, particularly a turbomachine according to any of the embodiments described herein, is described.

Figure 5:
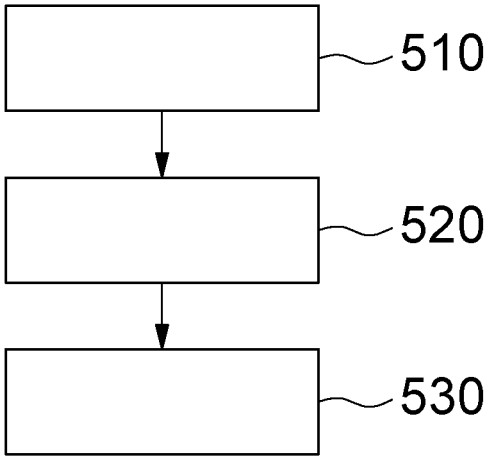
FIG. 5 is a flow diagram illustrating a method of operating a turbomachine according to embodiments described herein.

FIG. 5 is a flow diagram of a method of operating a turbomachine according to some embodiments. In box 510, a rotor 10 of the turbomachine is driven with a driving unit which is connected to a driven side 12 of the rotor. The driving unit may be a motor, e.g. an electric or a hydraulic motor. The rotor 10 may include one or more impellers which may be fixed at the rotor between the driven side and the second side of the rotor opposite the driven side.

In box 520, a process fluid such as a process gas is directed along a main flow path 30 which extends at least partially between the rotor 10 and a housing 20, wherein a gap between the rotor and the housing is sealed at the driven side of the rotor. The gap may be sealed with a sealing arrangement, particularly with a dry gas seal. A leakage of the process fluid from the main flow path through a clearance between the rotor and the housing at the driven side can be reduced or essentially prevented by the dry gas seal.

In box 530, a first magnetic bearing 50 which supports the second side 14 of the rotor opposite the driven side 12 is cooled with a portion of the process fluid.

In some embodiments, the portion of the process fluid may be allowed to stream from the main flow path 30 along a fluid passage 31 through a clearance 32 between the rotor and the housing into the bearing gap 52 of the first magnetic bearing 50. Accordingly, the first magnetic bearing 50 may be cooled with a portion of the process fluid which may be used as a cooling fluid for cooling the first magnetic bearing.

No dry gas seal may be provided at the second side 14 of the rotor. In particular, no dry gas seal for sealing a clearance between the rotor and the housing may be provided in an axial direction A between the free axial end 13 at the second side 14 of the rotor and one or more impellers 15 of the rotor.

In some embodiments, which may be combined with other embodiments described herein, a portion of the process fluid may be allowed to stream from the main flow path 30 along a second fluid passage 33 through a clearance between the rotor and the housing into a second bearing gap 56 of a second magnetic bearing 55 at the driven side of the rotor. Accordingly, the second magnetic bearing 55 may be cooled with a (further) portion of the process fluid which may be used as a cooling fluid for cooling the second magnetic bearing. In particular, the sealing arrangement 40 may be arranged on the outboard side of the second magnetic bearing 55, and/or no (further) dry gas seal may be arranged between the one or more impellers and the second magnetic bearing 55 in the axial direction of the rotor.

In some embodiments, respective portions of the process fluid are used for cooling both the first magnetic bearing 50 at the second side and the second magnetic bearing 55 at the driven side. In particular, no additional cooling source and/or cooling circuit for cooling the magnetic bearings may be provided.

In some embodiments, the first magnetic bearing and/or the second magnetic bearing may include at least one axial magnetic bearing and/or at least one radial magnetic bearing, respectively.

In some embodiments, an axial thrust of the rotor may be compensated by providing a pressure difference between a high-pressure side and a low-pressure side of a balance drum.

The magnetic bearings may heat up during the operation of the turbomachine. Accordingly, it may be reasonable to provide a fluid passage for a cooling medium through the bearing gaps of the magnetic bearings. The bearing gap of a magnetic bearing may be located between a lamination of the magnetic bearing on the rotor and a bearing housing which may surround the rotor. The lamination may rotate with the rotor during the operation of the turbomachine, whereas the bearing housing may be stationary. For example, the bearing housing may be connected to the housing 20 of the turbomachine. The bearing gap of a magnetic bearing may surround the rotor in a circumferential direction. The bearing gap may surround the rotor assembly in the shape of a thin cylinder barrel.

When using a cooling medium such as a saturated gas at a comparatively low temperature for cooling, there is a risk of gas condensation in the bearing gap. A condensation of a cooling medium in the bearing gap may lead to a liquid accumulation along the bearing gap. This may negatively affect the magnetic bearing over time, impacting the system stability and causing a trip of the rotor assembly.

According to some embodiments described herein, the turbomachine may include a fluid passage configured to deliver a portion of the process fluid through the bearing gap of the magnetic bearing for cooling the magnetic bearing. In other words, the process fluid, which may typically have a high pressure, is used as the cooling medium in the bearing gap of the magnetic bearing. Due to the high gas pressure and the potentially high temperature of the process fluid in the bearing gap, a condensation in the bearing gap can be reduced or entirely avoided. Instabilities of the rotor can be reduced or avoided.

According to embodiments described herein, which may be combined with other embodiments, a turbomachine is described. The turbomachine includes: a rotor 10 extending in an axial direction A and including a driven side 12 configured to be connected to a driving unit and a second side 14 opposite the driven side; a stationary portion extending around at least a portion of the rotor 10, wherein a main flow path 30 for a process fluid extends through the rotor 10 and the stationary portion, wherein the process fluid may alternately pass through the rotor and the stationary portion; a sealing arrangement 40 configured for sealing a gap between the rotor and the stationary portion at the driven side 12 of the rotor; and a first magnetic bearing 50 supporting the second side 14 of the rotor, wherein a fluid passage for a portion of the process fluid extends from the main flow path 30 through a bearing gap 52 of the first magnetic bearing 50.

According to further embodiments of the present subject matter, which may be combined with other embodiments described herein, a portion of the process fluid can be taken from the most upstream or the most downstream stage of the turbomachine, or else from an intermediate stage of the turbomachine. The term "most upstream stage" or "most downstream stage" used herein may be understood as the first impeller or the last impeller, respectively, along the main flow path 30 across the turbomachine. Depending upon whether the turbomachine is a power generating machine, through which the process fluid is expanded, or a power absorbing machine, such as a compressor, through which the process fluid is compressed, the most upstream stage can be the stage where the process fluid has the highest pressure or the stage where the process fluid has the lowest pressure, respectively.

Depending upon whether the turbomachine is a power generating machine, through which the process fluid is expanded, or a power absorbing machine, such as a compressor, through which the process fluid is compressed, the most downstream stage can be the stage where the process fluid has the lowest pressure or the stage where the process fluid has the highest pressure, respectively.

Figure 6:
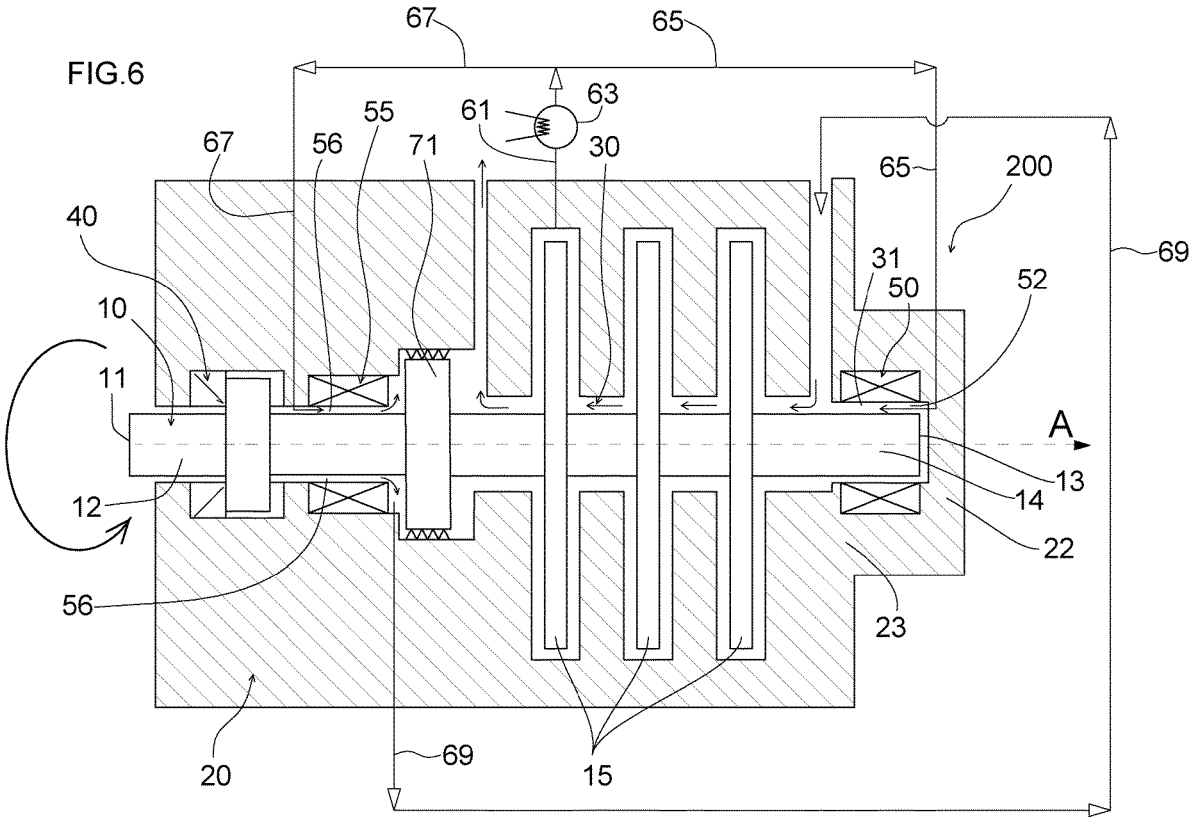
FIG. 6 is a schematic view of a turbomachine according to further embodiments described herein.

In FIG. 6, where the same reference numbers designate the same elements as described in the previous figures, an embodiment is schematically shown, wherein a first portion of process fluid for cooling the first bearing 50 can be drawn from the main flow path 30 at an intermediate stage of the turbomachine. A second portion of process fluid for cooling the second bearing 55 can further be removed from the same intermediate stage, as schematically shown in FIG. 6, or from a different intermediate stage. In some embodiments the first process fluid portion and/or the second working fluid portion can be taken from the stage where the highest process fluid portion is present. If the turbomachine 200 is a compressor, the first and/or the second process fluid portion can for instance be drawn from the most downstream stage of the compressor. The most downstream stage as understood herein also includes the delivery duct of the compressor.

In FIG. 6 a drawing line 61 is provided, through which process fluid is drawn from an intermediate stage of the turbomachine 200 and delivered through a first delivery line 65 towards the bearing gap 52 of the first magnetic bearing 50. Furthermore, a second delivery line 67 the second portion of process fluid can be delivered towards the bearing gap 56 of the second magnetic bearing 55.

In some embodiments, the first process fluid portion and the second process fluid portion can be cooled in a cooling device 63, for instance a heat exchanger. In FIG. 6 the first portion of process fluid and the second portion of process fluid are collectively drawn from the same intermediate stage of the turbomachine 200 and are collectively cooled in the same cooling device 63. The first portion of process fluid and the second portion of process fluid are divided downstream of the cooling device 63. In other embodiments, not shown, two separate cooling devices can be provided for the first and second portions of cooling fluid, which may be drawn from different points of the main flow path 30, for instance at different pressures.

The cooling device 63 can be adapted to reduce the temperature of the first and/or second portion of process fluid prior to delivering the process fluid into the bearing gap 52 or 56. Cooling of the first process fluid portion and second process fluid portion can be particularly beneficial if the portion of process fluid is drawn from a stage of the turbomachine, where the temperature of the process fluid flow is relatively high. For instance, if the turbomachine is a compressor, the temperature and the pressure of the process fluid increase in an upstream-to-downstream direction along the main flow path 30. If the portion of process fluid for cooling the magnetic bearing 50 and/or the magnetic bearing 55 is drawn from an intermediate or downstream stage of the turbomachine, cooling of the magnetic bearings 50 and 55 can be more efficient if the respective portion of process fluid is cooled prior to delivery in the respective bearing gap.

Similarly, if the turbomachine is a power-generating machine, the temperature and the pressure of the process fluid drops in an upstream-to-downstream direction, such that it may be beneficial to cool the portion of process fluid drawn from the main flow path 30 and intended for cooling of the magnetic bearings 50, 55, prior to delivering into the bearing gaps 52, 56, in particular if the portion of process fluid is drawn from an intermediate stage or the most upstream stage of the turbomachine.

Cooling of the first portion of process fluid, or of the second portion of process fluid, or both, can be particularly beneficial in terms of cooling efficiency and bearing temperature control. It can also make the use of process fluid as bearing cooling fluid feasible where the temperature of the process fluid in the main flow path 30 is otherwise too high for cooling purposes, for instance if the portions of cooling fluid are drawn from the last stage or from a downstream stage of a compressor, or else from the first stage, or from an upstream stage of a turboexpander or a turbine.

In some embodiments, using a portion of process fluid under pressurized conditions for cooling of the magnetic bearing(s) can be particularly beneficial in terms of cooling efficiency, and can be useful in facilitating or establishing a proper process fluid flow through the magnetic bearing(s), or the bearing gaps thereof. Since flowing through the bearing gaps entails pressure losses, a pressurized process fluid at the entry side of the bearing gap can result in improved flow conditions or better flow control. The term "process fluid under pressurized conditions" as used herein may be understood as process fluid at a pressure value higher than the lowest pressure of the process fluid along the main flow path. Thus, if the turbomachine is a compressor, for instance, a portion of process fluid under pressurized conditions can be a portion of process fluid drawn from any point of the main flow path downstream of the suction side. If the turbomachine is an expander or a turbine, the portion of process fluid can be drawn from any point of the main flow path upstream of the exit side.

In some embodiments, in a multi-stag compressor, process fluid under pressurized conditions can be drawn from a point of the main flow path 30 downstream of the first compressor stage.

Since the flowing conditions of the first portion of process fluid for cooling the first magnetic bearing 50 can be different than the flowing conditions of the second portion of process fluid for cooling the second magnetic bearing 55, said first portion of process fluid and said second portion of process fluid can be drawn from different points of the main flow path 30, under different pressurized conditions.

In some embodiments, the first portion of process fluid used for cooling the first magnetic bearing 50, the second portion of process fluid used for cooling the second magnetic bearing 55, or both the first portion and the second portion of process fluid can be recovered and re-circulated in the main flow path 30. This can be particularly beneficial if the process fluid cannot be vented in the environment, e.g. if the process fluid is potentially harmful, dangerous or polluting.

According to some embodiments, which can be combined with other embodiments described above, a process fluid recovery line can be provided, which can be directly or indirectly fluidly coupled to the first magnetic bearing 50 or to the second magnetic bearing 55, or to both of them. In some embodiments, separate first and second recovery lines can be arranged in direct or indirect fluid communication with the first magnetic bearing 50 magnetic bearing and with the second magnetic bearing 55, respectively.

In the embodiment shown in FIG. 6, the portion of process fluid used for cooling the first magnetic bearing 50 can be returned directly to the first stage of the compressor through the first bearing gap 52.

In other embodiments, not shown, the first bearing gap 52, or a volume fluidly coupled thereto, can be in fluid communication with a process fluid recovery line, adapted to return the exhausted first portion of process fluid, used to cool the first magnetic bearing 50, to the main flow path 30, e.g. at the suction side of turbomachine 200.

In the embodiment shown in FIG. 6 the second magnetic bearing 55 is fluidly coupled to a fluid recovery line 69, which returns the portion of process fluid used for cooling the second magnetic bearing 55 to the suction side of the compressor.

The recovery line or both recovery lines, if provided, can be directly or indirectly fluidly coupled with the main flow path 30, for instance with the inlet or with the outlet of the turbomachine, depending upon where the process fluid in the main flow path has the lowest pressure value. For instance, if the turbomachine 200 is a compressor the recovery line or lines can end in the first stage or at the suction side of the compressor.

The first portion of process fluid used to cool the first magnetic bearing 50 can thus be recovered once said portion of process fluid has removed heat from the first magnetic bearing 50. Similarly, if also the second magnetic bearing 55 is present and cooled by a respective portion of process fluid, this latter can be recovered after heat removal from the second magnetic bearing 55.

The points of the main flow path 30 where the first portion of process fluid and the second portion of process fluid are drawn and the points where said first and second portions of process fluid are returned to the main flow path 30 can be selected, for instance depending upon the fluid pressure which is desired or required in the bearing gaps 52, 56.

In some embodiments a balance drum 71 can be integrally formed with the rotor 10, or rigidly constrained thereto, for co-rotation therewith. In some embodiments, as shown in FIG. 6, the balance drum 71 can be arranged proximate the driven side 12 of the rotor 10. In some embodiments, the balance drum 71 can be arranged between the impeller 15 of the stage nearest to the driven side 12 of rotor 10, and the second magnetic bearing 55, as shown in FIG. 6. The side of the balance drum facing the impellers 15 is thus subject to the delivery pressure of the turbomachine 200, while the opposite side of the balance drum 71 is subject to the suction side pressure, or anyhow to a pressure lower than the delivery pressure, such that a thrust counter-acting the axial thrust applied by the fluid o the rotor 10 is generated, to reduce the load on the bearings.

One or more of the above described features of FIG. 6 can be used separately or in combination in one or more of the embodiments disclosed with respect to FIGS. 1, 2 and 3. In particular, for instance, while in FIGS. 1, 2 and 3 the portion of the process fluid delivered to the active magnetic bearings 50 or 55 are drawn from the turbomachine stage adjacent to the respective active magnetic bearing, in other embodiments, the portion of process fluid can be drawn from a stage of the turbomachine which is not adjacent to the respective bearing, as shown in FIG. 6. Additionally, in one or more of FIGS. 1 to 3, the portion of process fluid drawn from the main flow path 30 and intended to cool the active magnetic bearing 50 or the active magnetic bearing 55 can be cooled prior to flowing through the respective active magnetic bearing. Also, in any one of the embodiments of FIGS. 1, 2 and 3 a return line can be provided, to return the portion of the process fluid, which has been used for cooling the respective active magnetic bearing, to the main flow path 30.

While the foregoing is directed to embodiments of the disclosure, other and further embodiments of the disclosure may be devised without departing from the basic scope thereof, and the scope thereof is determined by the claims that follow.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims

What is claimed is:

1. A turbomachine, comprising:

a rotor extending in an axial direction and comprising a driven side configured to be connected to a driving unit and a second side opposite the driven side;

a housing extending around at least a portion of the rotor, wherein a main flow path for a process fluid extends between the rotor and the housing;

a sealing arrangement configured for sealing a gap between the rotor and the housing at the driven side of the rotor, the driven side of the rotor being accessible or protruding from an interior of said housing, so that a driving unit can be connected directly or indirectly thereto;

a first magnetic bearing supporting the second side of the rotor;

a second magnetic bearing supporting the driven side of the rotor;

a first fluid passage extending from the main flow path configured to deliver a first portion of the process fluid through a bearing gap of the first magnetic bearing to cool said first magnetic bearing; and a second fluid passage extending from the main flow path configured to deliver a second portion of the process fluid through a bearing gap of the second magnetic bearing to cool said second magnetic bearing, wherein the first fluid passage, the second fluid passage or both the first fluid passage and the second fluid passage is/are in fluid communication with the main flow path through a cooling arrangement adapted to remove heat from the process fluid drawn from the main flow path to cool the first magnetic bearing and the second magnetic bearing.

2. The turbomachine according to claim 1, wherein the main flow path is fluidly open toward the bearing gap of the first magnetic bearing, and the first fluid passage extends from the main flow path along a clearance between the rotor and the housing through the bearing gap of the first magnetic bearing and beyond a free axial end of the rotor.

3. The turbomachine according to claim 1, wherein the sealing arrangement comprises at least one dry gas seal.

4. The turbomachine according to claim 1, which is configured as a semi-sealed turbomachine, wherein the second side of the rotor terminates in the housing and is sealed by the housing.

5. The turbomachine according to claim 1, wherein no dry gas seal is provided at the second side of the rotor, and no dry gas seal for sealing a clearance between the rotor and the housing is provided in the axial direction between one or more impellers of the rotor and the first magnetic bearing and/or between the first magnetic bearing and a free axial end of the rotor.

6. The turbomachine according to claim 1, wherein the turbomachine is at least one of a compressor configured to pressurize the process fluid and a pump configured to remove the process fluid.

7. The turbomachine according to claim 1, wherein the rotor comprises one or more impellers arranged in the axial direction between the first magnetic bearing and the sealing arrangement.

8. The turbomachine according to claim 1, wherein the second magnetic bearing is arranged in the axial direction between the sealing arrangement and the main flow path, between the sealing arrangement and one or more impellers.

9. The turbomachine according claim 1, wherein the turbomachine is a back-to-back turbo-compressor, the rotor comprises a first plurality of impellers and a second plurality of impellers arranged between the driven side and the second side of the rotor, the main flow path comprises a first flow path section extending in a first main flow direction past the first plurality of impellers and a second flow path section extending in a second main flow direction past the second plurality of impellers, and the first main flow direction is opposite the second main flow direction.

10. The turbomachine according to claim 1, further comprising at least one balance drum configured to compensate an axial thrust of the rotor by providing a pressure difference between a high-pressure side and a low-pressure side of the balance drum.

11. The turbomachine according to claim 1, wherein the driven side and the second side of the rotor protrude out of the housing.

12. The turbomachine according to claim 4, wherein of said first fluid passage is in fluid communication with an intermediate stage or a high pressure stage of the turbomachine to deliver the first portion of the process fluid to the first magnetic bearing under pressurized conditions and/or said second fluid passage is in fluid communication with an intermediate stage or a high pressure stage of the turbomachine to deliver the second portion of the process fluid to the second magnetic bearing under pressurized conditions.

13. A turbomachine, comprising:

a rotor extending in an axial direction and comprising a driven side configured to be connected to a driving unit and a second side opposite the driven side;

a housing extending around at least a portion of the rotor, wherein a main flow path for a process fluid extends between the rotor and the housing;

a sealing arrangement configured for sealing a gap between the rotor and the housing at the driven side of the rotor, the driven side of the rotor being accessible or protruding from an interior of said housing, so that a driving unit can be connected directly or indirectly thereto;

a first magnetic bearing supporting the second side of the rotor;

a second magnetic bearing supporting the driven side of the rotor;

a first fluid passage extending from the main flow path configured to deliver a first portion of the process fluid through a bearing gap of the first magnetic bearing to cool said first magnetic bearing;

a second fluid passage extending from the main flow path configured to deliver a second portion of the process fluid through a bearing gap of the second magnetic bearing to cool said second magnetic bearing; and a first fluid recovery duct fluidly coupled to said first magnetic bearing and a second fluid recovery duct fluidly coupled to said second magnetic bearing configured to recover said first portion of the process fluid and/or said second portion of the process fluid delivered to either said first magnetic bearing or said second magnetic bearing and re-introduce said first portion of the process fluid and/or said second portion of the process fluid into the main flow path.

14. A method of operating a turbomachine, the method comprising:

driving a rotor of the turbomachine via a driving unit connected to a driven side of the rotor, said driven side being accessible or protruding from an interior of a housing of the turbomachine, so that a driving unit can be connected directly or indirectly thereto;

directing a process fluid along a main flow path extending between the rotor and the housing of the turbomachine, wherein, at the driven side of the rotor, a gap between the rotor and the housing is sealed, with a dry gas seal;

cooling a first magnetic bearing which supports a second side of the rotor opposite the driven side with a first portion of the process fluid, which is delivered through a bearing gap of the first magnetic bearing;

cooling a second magnetic bearing which supports the driven side of the rotor opposite the second side with a second portion of the process fluid, which is delivered through a bearing gap of the second magnetic bearing; and cooling said first portion of the process fluid and/or said second portion of the process fluid prior to directing said first portion of the process fluid to the first magnetic bearing and said second portion of the process fluid to the second magnetic bearing.

15. A method of operating a turbomachine, the method comprising:

driving a rotor of the turbomachine via a driving unit connected to a driven side of the rotor, said driven side being accessible or protruding from an interior of a housing of the turbomachine, so that a driving unit can be connected directly or indirectly thereto;

directing a process fluid along a main flow path extending between the rotor and the housing of the turbomachine, wherein, at the driven side of the rotor, a gap between the rotor and the housing is sealed, with a dry gas seal;

cooling a first magnetic bearing which supports a second side of the rotor opposite the driven side with a first portion of the process fluid, which is delivered through a bearing gap of the first magnetic bearing;

cooling a second magnetic bearing which supports the driven side of the rotor opposite the second side with a second portion of the process fluid; and recovering said first portion of the process fluid from the first magnetic bearing and said second portion of the process fluid from the second magnetic bearing and re-directing said first portion of the process fluid and/or the second portion of the process fluid to the main flow path.

16. The method according to claim 15, wherein the first portion of the process fluid is allowed to stream from the main flow path along a fluid passage through a clearance between the rotor and the housing into the bearing gap of the first magnetic bearing.

17. The method according to claim 15, wherein no dry gas seal is provided at the second side of the rotor, and no further dry gas seal for sealing a clearance between the rotor and the housing is provided in an axial direction between a free axial end of the second side and one or more impellers of the rotor.

18. The method according to claim 15, further comprising compensating an axial thrust of the rotor by providing a pressure difference between a high-pressure side and a low-pressure side of a balance drum.

19. The method according to claim 15, further comprising removing of said first portion of the process fluid and/or said second portion of the process fluid from an intermediate stage of the turbomachine.

* * * * *